United States Patent [19]

Pearce et al.

[11] 3,948,471

[45] Apr. 6, 1976

[54] MODULAR KITE SYSTEM

[75] Inventors: Peter J. Pearce; Toby J. Cowan, both of Studio City; Mark E. Jurey, Reseda, all of Calif.

[73] Assignee: Synestructics, Inc., Chatsworth, Calif.

[22] Filed: Sept. 16, 1974

[21] Appl. No.: 506,321

[52] U.S. Cl. ..... 244/153 R

[51] Int. Cl.[2] ..... B64C 31/06

[58] Field of Search ..... 244/153 R, 154, 155 R, 244/155 A; 46/29, 77; 403/176

[56] References Cited

UNITED STATES PATENTS

| | | | |
|---|---|---|---|
| 1,223,163 | 4/1917 | Graham | 244/153 |
| 1,261,731 | 4/1918 | Fronsdahl | 244/154 |
| 1,328,143 | 1/1920 | Fergusson | 244/153 R |
| 1,346,956 | 7/1920 | Hale | 244/154 |
| 1,666,813 | 4/1928 | Eddy | 244/154 |
| 1,724,539 | 8/1929 | Wilder | 244/153 R |
| 2,023,939 | 12/1935 | Talmadge | 244/154 |
| 2,769,605 | 11/1956 | Sparkman | 244/153 R |
| 3,600,825 | 8/1968 | Pearce | 46/29 X |

FOREIGN PATENTS OR APPLICATIONS

| | | | |
|---|---|---|---|
| 12,151 | 7/1910 | France | 244/154 |
| 235,722 | 5/1909 | Germany | 244/153 R |

*Primary Examiner*—Trygve M. Blix
*Assistant Examiner*—Galen L. Barefoot
*Attorney, Agent, or Firm*—Marvin H. Kleinberg

[57] ABSTRACT

A kite having a prism-shaped three dimensional frame, spanned by aerodynamic surfaces on its two downward disposed faces. The top or upward disposed face is spanned by a novel aerodynamic surface called an air dam which operates to stabilize the flight of the kite while greatly increasing the lift. A tail consisting of struts spanned by an aerodynamic surface is also provided. The frame is built from a number of identical struts and identical connectors. Each aerodynamic surface consists of two unitary congruent sheets positioned facewise against each other and joined together along their edges. The struts are inserted between the sheets along the edges where the sheets are joined together. This simple basic structure facilitates assembly and reduces cost while providing a high strength-to-weight ratio and stable flying qualities. Combination kites may be assembled by joining several basic kites in various ways.

13 Claims, 17 Drawing Figures

MODULAR KITE SYSTEM

BACKGROUND OF THE INVENTION

The present invention relates to kites and, more particularly, a novel kite module that can be flown alone or, in combination with other similar modules, can be assembled into a complex kite configuration. Both the module and the complex combination of modules are easy to fly and are controllable and stable in flight.

One type of kite which flies in a stable manner and which utilizes a frame of minimum weight and complexity is a kite of triangular cross section. The advantages of this design of kite were related by Alexander Graham Bell at the beginning of this century.

An improved version of Bell's kite is disclosed in Applicant's co-pending application Ser. No. 414,531, dated Nov. 9, 1973, "Tetrahedral Kite Structure." The present invention has several novel features which make it superior to kites of the prior art. These features include a structure that is strong, lightweight, easy to assemble, and inexpensive to manufacture, and a novel aerodynamic surface called an air dam which results in more stable flight characteristics and increased lift.

SUMMARY OF THE INVENTION

In accordance with one embodiment of the present invention, a kite having a unique structural configuration is provided, employing low cost components that can be easily manufactured and assembled with a minimum of effort into a kite that flies easily and in a stable manner. The novel kite configuration results in a high strength-to-weight ratio.

A novel element of the kite, called an "air dam" operates to provide stability of flight while greatly increasing the effective lift. The kite includes a frame having struts arranged along the edges of the aerodynamic surfaces and held together by specialized connectors at their intersections.

The basic kite module is supplied in kit form. Normally, several of the basic kite modules would be assembled and then combined into a variety of larger kites. A larger number of combination kites can be formed from the basic kite module and the combination kites differ considerably in appearance.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

FIGS. *6a* and *6b* shows the connector and the strut used in the structure.

Figure 1:
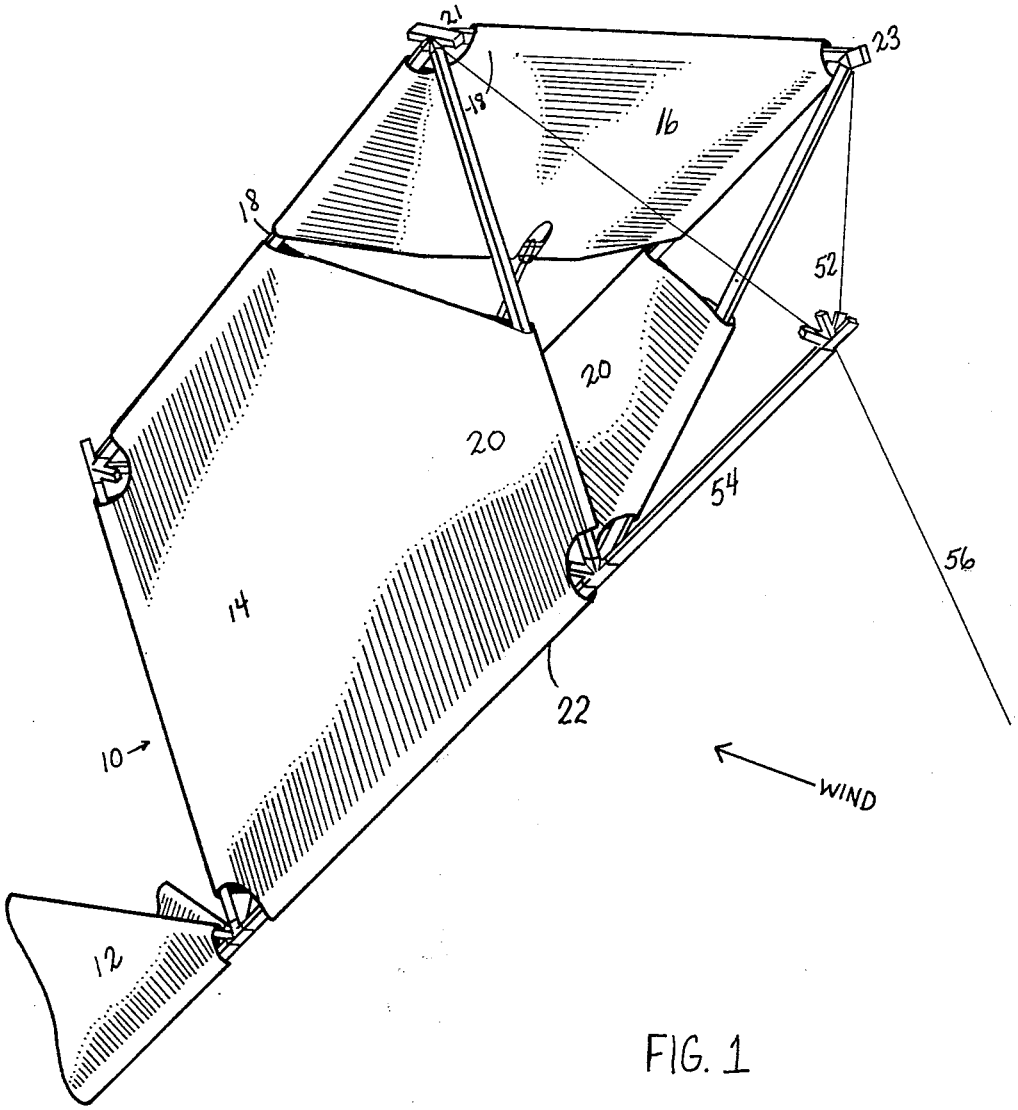
FIG. 1 is a perspective view of a basic kite module.

FIGS. *7a–7j* inclusive, shows bottom plan views for a number of combination kites respectively, formed from the basic kite module of FIG. 1.

DESCRIPTION OF THE PREFERRED EMBODIMENTS

Turning first to FIG. 1, there is shown a basic or elemental kite module 10 structure, which can be used by itself, or in combination with other like structures, as will be described below. The kite is launched from the ground by means of a flying string attached to the kite as shown, that is pulled towards the incoming direction of the wind. Once the kite is airborne, it will fly in the orientation shown in FIG. 1 in a stable manner and without an additional kite tail.

As shown in FIG. 1, the basic kite module 10 includes a frame composed of 13 elongated struts, joined together by 6 connectors. The details of the connectors and the attachment of the struts to the connectors will be described below. The kite also includes three pieces of plastic which form the aerodynamic surfaces of the kite.

Figure 2:
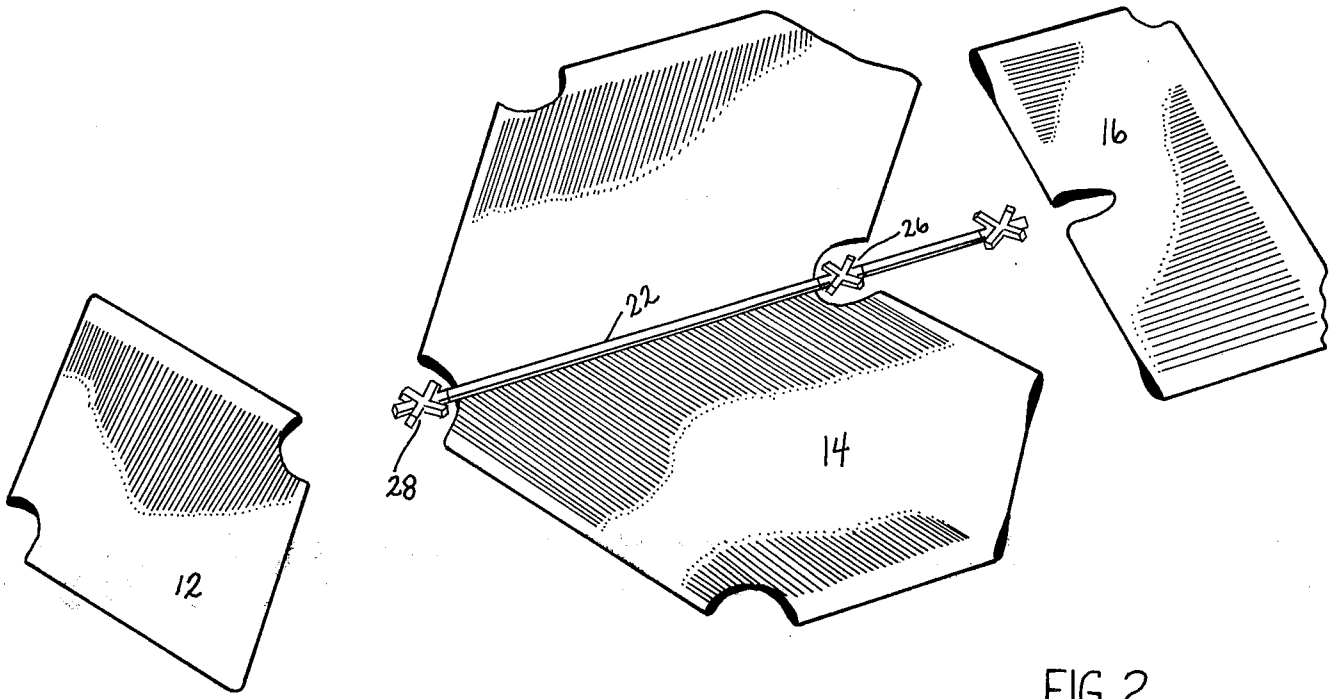
FIG. 2 is an exploded perspective view of the parts of the kite module of FIG. 1.

As shown in the exploded view of FIG. 2, these surfaces include the "tail" 12, the "sail" 14 and the "air dam" 16. Each of these aerodynamic surfaces is preferably formed of a double thickness of plastic film, which enables low cost production of these parts and ease in mounting them on the frame of the kite. As will be seen in FIG. 1, the aerodynamic surfaces are held taut by the struts 18 which are inserted between the two layers of plastic film.

The tail 12 of the kite and the sail 14 of the kite each consist of two planar surfaces 20 held at a common dihedral angle. This aerodynamic configuration is formed by folding the tail and the sail about the keel strut 22 as shown in FIG. 2.

Figure 3:
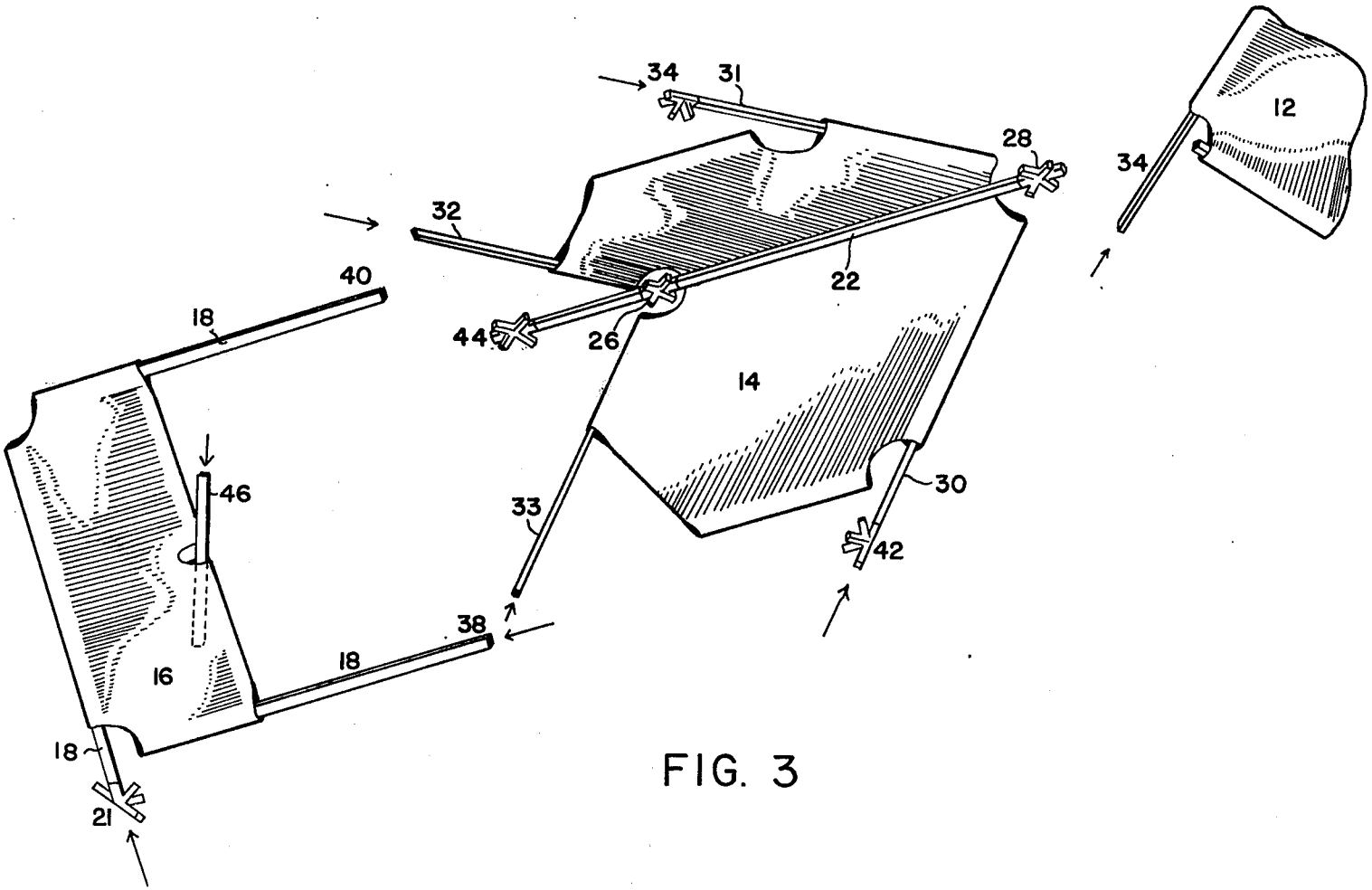
FIG. 3 is an exploded perspective view showing how the elements of the kite are assembled.

The air dam 16 also consists of a double layer of plastic film which is supported on three sides by struts 18 which lie in a plane located at the "top" of the kite, as shown in FIG. 3. The fourth side of the air dam 16 is drawn downward from said plane by an elastic band 24 connected at one end to the keel in the region of the tail and at the other end to a rigid plastic strut inserted between the layers of the air dam and extending laterally about half the distance from the center line to the top frame structure but not connected to the frame structure. The purpose and function of the air dam will be explained below.

A better understanding of the kite can be gained by considering the manner in which the kite is assembled. A kit for producing the basic kite 10 module includes one tail 12, one sail 14, one air dam 16, 6 connectors, 13 struts, one air dam tensor element, one rubber band 24, and one piece of string.

As shown in FIG. 2, the tail aerodynamic surface 12 is a diamond shaped double layer of plastic film such as polyethylene, heat sealed around its edges. Likewise, the sail 14 also consists of a double thickness of plastic film, heat sealed around its edges, and having the general form of two rhombic figures joined along a common side which coincides with the keel line 22.

The air dam 16 is a double thickness of plastic film sealed along the edges and having a rectangular shape. These plastic parts may be supplied as described, in which case it is necessary for the builder to trim the corners of the plastic pieces. in the manner shown in FIG. 2, by cutting the corners diagonally or by making an arcuate cut at the corners.

After the corners have been cut out of the plastic sheets, connectors 26,28 are placed on each end of the keel strut 22. Next, the sail portion 14 is folded around the keel strut 22 and the sail support members 30-33 inclusive are inserted between the layers of the sail and into the connectors 26 and 28 at either end of the keel 22, as shown in FIG. 3.

The tail assembly is formed by attaching a strut 34 onto the tail-most connector 28 attached to the keel 22, forming an extension of the keel piece. Next the plastic film tail piece 12 is folded around this extension of the keel and two struts 35 and 36 are inserted between the layers of the plastic film and then those struts also are attached to the connector.

Figure 4:
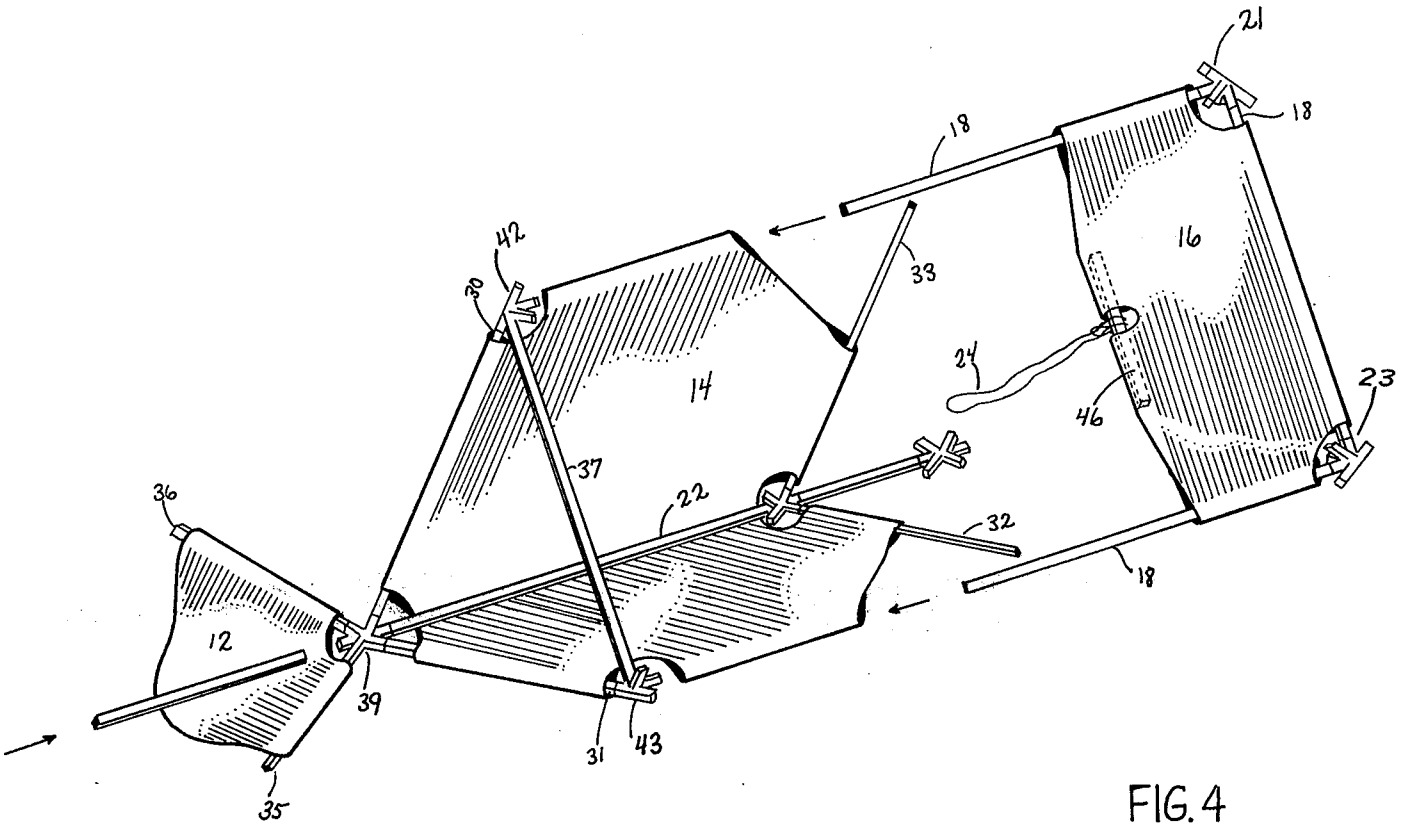
FIG. 4 shows a latter state of the assembly of the kite module.

In the next step of the assembly, struts 18 are inserted along three edges of the air dam 16; these three struts are held together in a plane by the use of two connectors 21 and 23, shown in FIG. 4, to form an open ended rectangle. The two unconnected ends of this structure 38 and 40 are then inserted into connectors 42 and 43 which have been attached to the ends of the sail support members 30 and 31. The two connectors 21 and 23 at the forward end of the air dam 16 are attached to the forward sail support struts 32 and 33, as indicated in FIG. 3.

Finally, a strut 37 completing the top rectangular frame is inserted between the connectors 42 and 43 at the ends of the sail support members 30 and 31. Before the kite is flown, the air dam tensor member 46 should be inserted and a rubber band 24 attached between its center and the keel member 22 at the region of the tail 39, as shown in FIG. 4.

Figure 5:
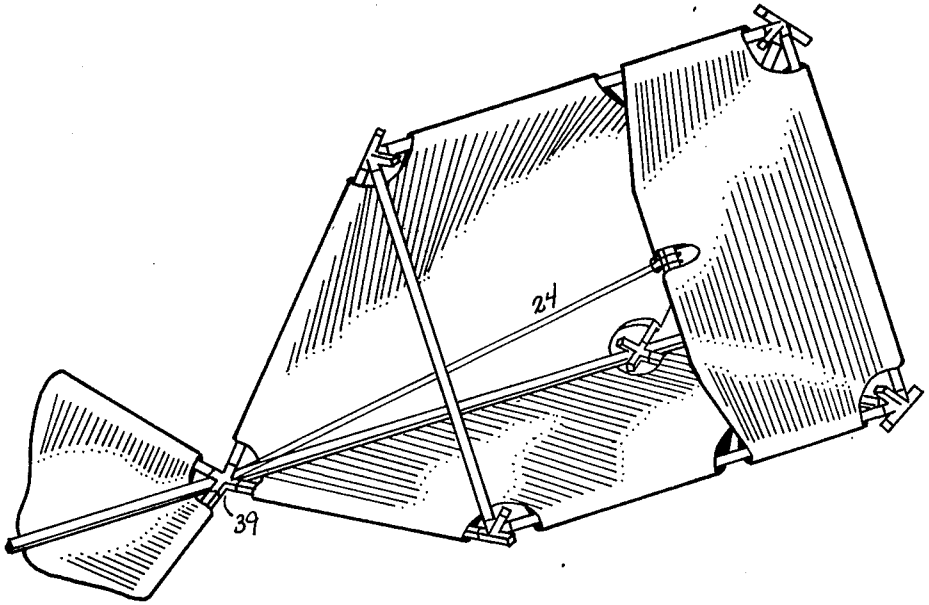
FIG. 5 shows the assembled unit of FIG. 1 in a top perspective view.

Before the kite is flown, each of the two top forward corners 21,23 of the kite frame should be connected by a string 52 to the attachment point, which is at the frontmost end of the short strut 54 which is a forward extension of the keel. The purpose of these strings is to distribute tension to the frame from the point of attachment of the flying string, as shown in FIG. 1. The completed basic kite is shown in top view in FIG. 5. The flying string 56 normally is attached to the forward end of the short strut 54. The kite may be launched by the classic technique of having the operator run into the wind while gradually playing out the flying string.

The use of double-walled plastic film aerodynamic surfaces, and particularly surfaces which are wrapped about one edge of the frame to provide two surfaces, enables low cost production and assures good strength with a minimum of weight and complexity. Double-walled aerodynamic surfaces can be easily produced from a double-walled roll of material which is heat sealed on the remaining edges by cutting the double-walled row with a heated die that seals the sheets together at the cut.

The attachment of these aerodynamic surfaces to the struts of the frame is accomplished in a simple manner, as seen above. The stresses in the aerodynamic surfaces are evenly distributed along the length of the struts. Because the tail and the sail are folded around the keel and its extension, assembly of the kite is facilitated.

Figure 6A:
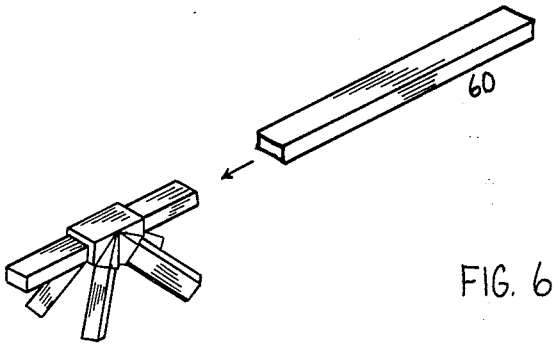
Figure 6B:
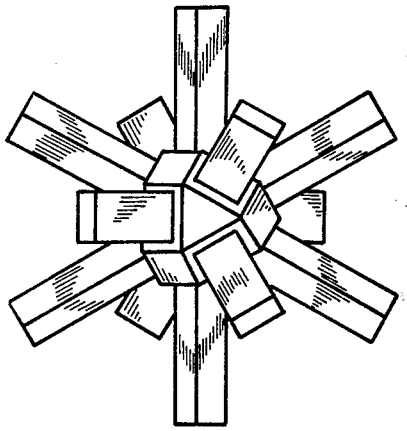

To assure proper assembly of the kite the struts are created with a hollow cross section, as shown in FIG. 6. The cross section is substantially rectangular, however, the longer sides of the rectangle are arched inward. This improves the tightness of the fit when a strut is attached to a connector. This general cross sectional design for the struts was disclosed in my earlier application Ser. No. 414,531 filed November 9, 1973. "Tetrahedral Kite Structure." Since the filing of that application, the design has been further refined by increasing the extent of the inward arch and decreasing the wall thickness. These improvements further improve stiffness and tightness of fit, while reducing the weight. Each connector has the shape shown in FIG. 6a and is molded of a high strength plastic. Although each connector has 6 spokes, it can be seen from the previous figures that not all 6 spokes are always used in building the basic kite. FIG. 6b shows a 12 spoked connector required for assembling combination kites.

As one assembles the kite, it is possible that the "wrong" spokes of a connector will be utilized to hold together certain combinations of struts. The use of non-square, rectangular connector spokes and struts minimizes the chance of confusion, because it eliminates a number of possible orientations of a connector after it has been attached to one strut.

If strut 60 of FIG. 6*a* were inadvertently attached to the "wrong" spoke of the connector, it would quickly become clear that one strut of the frame could not be received onto any of the spokes, because the spokes closest to alignment with it would still be 90° out of alignment from the required spoke orientation.

Thus, it can be seen that the entire basic kite framework can be built up from five struts of one length, nine struts having twice that length, and seven connectors. The unique structural design of the kite is responsible for the simplicity of its structure, and this novel feature results in both ease and simplicity of construction and reduced manufacturing cost.

Although mention has been made of the air dam and the tail, the kite will fly without them, using only the sail aerodynamic surface. When the sail only is used, the wind impinging on the lower surface of the sail is forced to change its direction and hence its momentum vector. This change of momentum results in a force being exerted on the sail. This aerodynamic force vector may be resolved into the classic lift and drag components which, combined with the weight of the kite and the tension of the flying string, determine the motion of the kite.

The attitude of the kite is determined by equilibrium of the rotational moments exerted on the kite by the aerodynamic force acting at the center of pressure and the tension of the flying string acting at its point of attachment.

Stability of the kite about an imaginary axis of rotation parallel to the keel is assured by the dihedral angle at which the halves of the sail are inclined. The action of this dihedral can be illustrated as follows. In a wind of steady speed the kite flies with the keel inclined to the horizontal and with the halves of the sail symmetrically disposed on either side of a vertical plane containing the keel. Next, suppose an external force has caused the kite to roll about the keel line in a clockwise direction as seen from in front of the kite. To an observer in front of the kite the right half of the sail has become more nearly horizontal and the left half has become more nearly vertical. As a result, the lift produced by the right half has increased and the lift of the left half has decreased. The net effect is a torque tending to rotate the kite counterclockwise about the keel, and this tends to restore the kite to its normal flight attitude. Thus, the dihedral of the sail tends to make the kite self-righting, i.e., stable.

The terms "leading", "forward", and "upwind" refer to parts of the surfaces disposed nearest the point of attachment of the flying string shown in FIG. 1. The terms "trailing," "rearward", and "downwind" refer to areas fartherest from the point of attachment.

Another novel feature of the present invention is the provision of an air dam. As explained above, the rubber band attached to the air dam tensor element urges the trailing edge of the air dam inward or downward. This has a funneling effect on the wind that is blowing through the kite, resulting in a greater air velocity on the upper surfaces of the sail than exists on the lower surfaces of the sail.

This difference in air velocities results in a Bernoulli lift effect which is advantageous in overcoming the weight of the kite, particularly when the wind velocity is slight. As the wind velocity increases, as might be the case if a gust of wind were encountered, aerodynamic force caused by the wind against the lower surface of the air dam urges the surface of the air dam upward and outward, overcoming the force supplied by the rubber band.

When a gust of wind has thus forced the trailing edge of the air dam above the topmost square frame of the kite, the funneling effect is spoiled. Air passing through the kite no longer has a greater velocity than the air passing over the lower surfaces of the sails. The air dam itself also supplies lift to the kite.

When the wind velocity is relatively slight, the rubber band depresses the trailing edge of the air dam so that the air dam has a generally higher "angle of attack" than it would have if its trailing edge were supported by a rigid cross member. The larger angle of attack results in greater lift at low wind speeds.

As the speed of the wind increases, forcing the air dam upward and outward, the angle of attack of the air dam is necessarily reduced. This reduction in the angle of attack results in less lift being generated notwithstanding greater wind speed. This results in a more stable operation in the presence of wind gusts.

One of the most striking features of the present invention is that the basic kite configuration lends itself to the formation of a plurality of kites composed of a combination of basic kites. FIG. 7, including FIGS. 7*a*–7*j* inclusive illustrate a number of these combinations as seen from below; that is, bottom view. In FIG. 7*a*, the basic kite configuration is shown.

In many examples, if the basic kite is to be used in combination, the tail assembly can be omitted on the elemental kites. In addition, it will be noted that certain other parts are used in forming the combinations, including additional struts and connectors, as well as a rectangular element called a wing. In shape, the wing resembles somewhat the air dam and is also formed of a double layer of plastic film joined at the edges of the rectangle, and is supported by a rectangular structure of struts and connectors.

Thus, the structure of these wing elements is very similar to the structure of the other elements of the basic kite. It is anticipated that each basic kite kit can be provided, if desired, with the structural components required for two wing panels. These wing panels may be attached to the combination structures in a number of ways as shown in FIG. 7. For example, the combination of FIG. 7*d* consists of four basic kite modules plus four wing panels; the basic kites are connected end to end in a row, and wing panels are attached in the space between the first and second kites and between the second and third kites on either side of said kites in the plane of the top frame of the kites. Thus, the kit for the basic kite to be used in combinations would include, in addition to the items described above, additional struts of the longer length, additional struts of the shorter length, and additional suitable connectors.

Figure 7G:
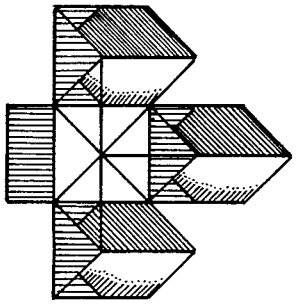
Figure 7H:
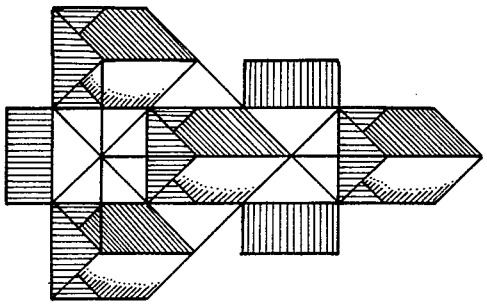
Figure 7E:
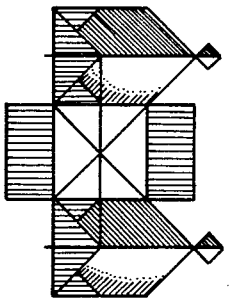
Figure 7I:
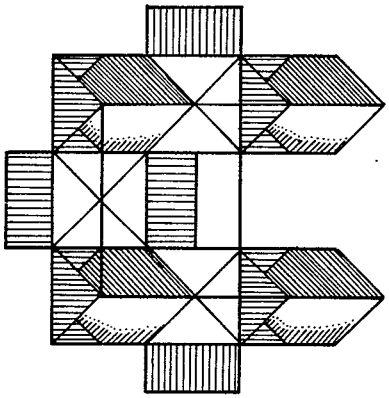
Figure 7A:
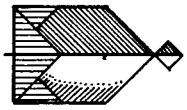
Figure 7J:
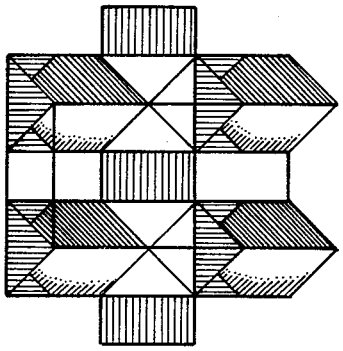
Figure 7B:
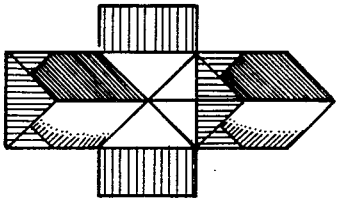
Figure 7C:
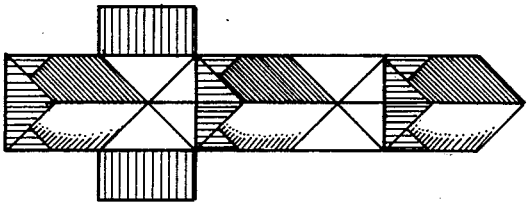
Figure 7F:
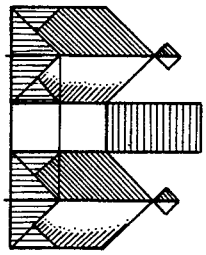
Figure 7D:
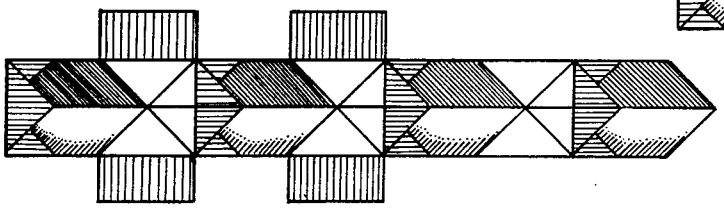

The combination kites of FIGS. 7*b* through 7*d* can be formed by joining two, three, or four of the basic kites end to end. Wings are added as shown in the figures.

Likewise, the kites of FIGS. 7*e* and 7*f* can be formed by joining two basic kites laterally. The connection is effected by struts which also carry the wing surfaces, as shown. The combinations of FIGS. 7*g*, 7*h*, 7*i*, and 7*j* are higher order combinations.

It is desirable to use two strings when flying the combinations shown in FIGS. 7*e*, *g*, *h*, *i*, and *j*. By manipulating the relative lengths of the strings, the combination kite can be made to execute a number of maneuvers, as will be obvious to those skilled in the art.

Thus, the invention provides a basic kite module of high strength-to-weight ratio, and which can be manufactured at low cost and readily assembled by a user. All of the aerodynamic surfaces of the kite are constructed of a double layer of plastic film joined together around their edges. This facilitates attachment of the aerodynamic surfaces to the framework of the kite without the need for separate fasteners and the like, inasmuch as it permits struts of the framework to be attached by merely inserting them between the sheets so they lie against the edges of the joined sheets. The framework may be constructed of a number of identical struts and identical connectors with minimal confusion by utilizing non-square rectangular struts and corresponding connectors.

A number of alternative embodiments are conceivable in addition to the preferred embodiment described above. For example, it is not necessary to use a double layer of plastic film to form the aerodynamic surfaces, although doing so results in a more easily assembled kit. A single layer of film would be just as effective aerodynamically and would weigh even less. Other materials such as paper or silk could also be used for the aerodynamic surfaces in place of plastic. Likewise, the struts and connectors do not have to be made of plastic but could be made of other materials such as wood or compressed paper or metal. The cross section of the struts could be of some shape other than rectangular, although the advantages of the rectangular section were described above. The preferred embodiment shows a tail having a structure generally similar to the structure of the sails. The preferred tail could be eliminated and a tail of the more classic kind, or some alternative configuration, could be used in its place. Similarly, the preferred embodiment includes an air dam. The kite will fly without the air dam, although it flies better with it. Thus, an alternate embodiment might omit the air dam. So great is the stability of the basic wing configuration that the kite will even fly minus both the tail and the air dam, although such an embodiment is not optimum. These and similar alternative embodiments are considered to be obvious to one skilled in the art and are well within the scope of the present invention.

Although particular embodiments of the invention have been described and illustrated herein, it is recognized that modifications and variations may readily occur to those skilled in the art and consequently, it is intended that the claims be interpreted to cover such modifications and equivalents.

What is claimed as new is:

1. A kite comprising:

a. a prism-shaped three-dimensional frame having a plurality of struts and a plurality of connectors arranged to define a rectangle and two equilateral triangles each having a side in common with a different end of said rectangle and having vertices opposite the common sides joined by a keel strut to form two similar parallelograms, said parallelograms sharing said keel strut as a common side and wherein the struts adjacent said keel strut form an acute angle with respect to an imaginary upwind extension of said keel strut;

b. a sail spanning said pair of parallelograms to form aerodynamic surfaces, said sail being folded around said keel strut and truncated at its upwind corners, whereby said sail does not extend along the upwind portions of the sides of said parallelograms opposite said keel strut; and c. an air dam aerodynamic surface having an edge attached to the upwind end of said rectangular frame and having a stiffened downwind edge, normally yieldingly urged inward toward the centerline of said three-dimensional frame and away from the upwind end of said rectangular frame, said stiffened downwind edge being capable of moving outward from the centerline of said frame by a distance related to the magnitude of the windspeed, and further comprising tension means for urging said stiffened downwind edge of said air dam inward toward said centerline of said frame and away from said upwind edge of said rectangular frame.

2. The kite described in claim 1 wherein said sail includes two unitary congruent sheets positioned facewise against each other, substantially in contact over their entire surfaces and joined together along their edges, having a common side coincident with said keel strut and symmetrically disposed about said keel strut, and wherein the struts forming the non-common sides of said parallelograms extend between said sheets along the joined edges of said sheets.

3. The kite described in claim 1 wherein: said frame includes nine identical struts and six identical connectors, said connectors having guide means to receive the struts and to define the orientation of said struts, whereby construction of the kite is facilitated.

4. The kite described in claim 1 wherein said air dam includes two unitary congruent rectangular sheets positioned facewise against each other and joined together along their edges, and having a strut forming said upwind edge of said rectangular frame extending between said sheets along an edge where said sheets are joined together.

5. The kite described in claim 1 further comprising a tail assembly which includes:

a. a keel extension strut connected to the downwind end of said keel strut and forming an extension of said keel strut;

b. two tail struts connected to said downwind end of said keel strut and forming equal angles with said keel extension strut; and c. a tail spanning the planes defined by a tail strut and said keel extension strut to form aerodynamic surfaces, said tail folded being around said keel extension strut.

6. The kite described in claim 5 wherein said tail includes two unitary congruent sheets positioned facewise against each other, substantially in contact over their entire surfaces and joined together along their edges, each sheet having the shape of two identical triangles having a common side coincident with said keel extension strut and symmetrically disposed about that side, said tail struts extending between said sheets along said joined edges.

7. The kite of claim 1 wherein said acute angle between said keel strut and the struts adjacent it is an angle between 40° and 80°.

8. In a kite of the type having a frame structure with two plane aerodynamic surfaces intersecting at a dihedral angle and spreading in a generally upward direction when the kite is being flown, the improvement comprising: an air dam located above and between the aerodynamic surfaces, said air dam having its upwind edge attached to a normally horizontal lateral cross member of the frame and having a stiffened downwind edge; and tension means for yieldingly urging the center of the downwind edge of said air dam toward the downwind end of the line of intersection of the plane aerodynamic surfaces, whereby the stiffened downwind edge is capable of moving away from the line of intersection by a distance related to the windspeed.

9. A kit for constructing a kite comprising:

a. nine struts;

b. six connectors having guide means to receive the struts and to define the direction of the struts;

c. a sail having the shape of two identical parallelograms sharing a common side and symmetrically disposed about that side, the sides of said parallelograms adjacent said common side forming an acute angle with an imaginary extended line coincident with said common side, said sail having its two acute-angled corners truncated by a substantial fraction of the length of the edges of said sail forming the truncated corners.

10. The kit described in claim 9 wherein said sail includes two unitary congruent sheets positioned facewise against each other and joined together along their edges, whereby an edge of said sail can be held to a strut by inserting said strut between the sheets immediately inside an edge of said sail.

11. The kit described in claim 9 further comprising:

a. a tail assembly including a keel extention strut;

b. two tail struts similar to each other and non-identical to said nine struts;

c. a tail aerodynamic surface;

d. an air dam aerodynamic surface; and e. air dam tension means adapted to be coupled to the point of attachment of said keel extension strut.

12. The kit described in claim 11 wherein said tail aerodynamic surface includes two unitary congruent sheets positioned facewise against each other, substantially in contact over their entire surfaces and joined together along their edges, each sheet having the shape of two identical triangles having a common side, said sheets being symmetrically disposed about that side.

13. The kit described in claim 11 wherein said air dam aerodynamic surface includes two unitary congruent rectangular sheets positioned facewise against each other and joined together along their edges.

* * * * *